US010018403B2

(12) United States Patent
Lee et al.

(10) Patent No.: US 10,018,403 B2
(45) Date of Patent: Jul. 10, 2018

(54) REFRIGERATOR

(71) Applicant: SAMSUNG ELECTRONICS CO., LTD., Suwon-si, Gyeonggi-do (KR)

(72) Inventors: Jee-Hoon Lee, Seoul (KR); Jea Won Lee, Hwaseong (KR); Yong Soo Kyong, Incheon (KR); Yang-Yeol Gu, Gwangju (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 15/075,657

(22) Filed: Mar. 21, 2016

(65) Prior Publication Data

US 2016/0273826 A1 Sep. 22, 2016

(30) Foreign Application Priority Data

Mar. 20, 2015 (KR) ..... 10-2015-0038975

(51) Int. Cl.
*A47B 96/04* (2006.01)
*F25D 23/02* (2006.01)
(Continued)

(52) U.S. Cl.
CPC ..... *F25D 23/028* (2013.01); *E05D 1/06* (2013.01); *E05D 7/081* (2013.01); *F25D 11/00* (2013.01);
(Continued)

(58) Field of Classification Search
CPC ..... F25D 11/00; F25D 23/087; F25D 23/028; F25D 23/02
(Continued)

(56) References Cited

U.S. PATENT DOCUMENTS 2,309,001 A * 1/1943 Nave ..... E05D 3/02 16/379
2,319,600 A * 5/1943 Heath ..... F25D 23/028 16/389
(Continued)

FOREIGN PATENT DOCUMENTS

CN 1104288 A 6/1995
CN 201203324 Y 3/2009
(Continued)

OTHER PUBLICATIONS

Partial European Search Report dated Aug. 4, 2016 in corresponding European Patent Application No. 16161123.1.
(Continued)

*Primary Examiner* — Daniel J Troy
*Assistant Examiner* — Timothy M Ayres
(74) *Attorney, Agent, or Firm* — Staas & Halsey LLP

(57) ABSTRACT

A refrigerator includes a door including a rotation part protruding outward from a side surface of the door, and a protection member configured to face a side surface part of the door and having at least some parts disposed between the rotation part and the main body when the door is closed, such that a user's finger is prevented from being caught between the main body and the door during rotation of the door. No magnet is installed in the gasket, a separate magnet member is provided while spaced apart from the gasket, thereby reducing the thickness of the gasket, improving the energy efficiency of the refrigerator. A seating member for seating a hot pipe thereon is provided in a partition wall of the refrigerator, thereby minimizing cool air of a storage chamber leaking to the outside.

18 Claims, 10 Drawing Sheets

(51) Int. Cl.

| | |
|---|---|
| ***F25D 11/00*** | (2006.01) |
| ***E05D 1/06*** | (2006.01) |
| ***E05D 7/081*** | (2006.01) |
| *E05D 11/00* | (2006.01) |

(52) U.S. Cl.
CPC ... *E05D 2011/0072* (2013.01); *E05Y 2800/12* (2013.01); *E05Y 2800/41* (2013.01); *E05Y 2900/31* (2013.01); *F25D 2323/024* (2013.01)

(58) Field of Classification Search
USPC ..... 312/405
See application file for complete search history.

(56) References Cited

U.S. PATENT DOCUMENTS 2,795,019 A * 6/1957 Royall, Jr. ..... F25D 23/028 49/498.1
2,845,321 A * 7/1958 Saunders ..... E05B 65/0042 16/389
3,294,462 A * 12/1966 Kesling ..... F25D 23/02 220/592.1
4,335,671 A * 6/1982 Warner ..... B63B 1/286 114/274
4,592,604 A * 6/1986 Wilke ..... A47B 67/005 16/221
5,117,587 A * 6/1992 Doan ..... E06B 7/2309 49/383
5,560,694 A * 10/1996 Banicevic ..... F25D 23/087 312/405
5,564,808 A * 10/1996 Gipson, Jr. ..... F25D 23/10 312/296
7,104,621 B2 * 9/2006 Choi ..... F25D 23/087 312/296
9,250,009 B2 * 2/2016 Kentner ..... E06B 7/36
2004/0069422 A1 * 4/2004 Hormann ..... E05D 15/242 160/229.1

FOREIGN PATENT DOCUMENTS

| | | | |
|---|---|---|---|
| CN | 102257339 | A | 11/2011 |
| CN | 102927740 | A | 2/2013 |
| CN | 202810594 | U | 3/2013 |
| EP | 3 040 661 | A1 | 7/2016 |

OTHER PUBLICATIONS

Extended European Search Report dated Nov. 17, 2016, in corresponding European Patent Application No. 16161123.1.
European Office Action dated Aug. 17, 2017 in corresponding European Patent Application No. 16161123.1.
Chinese Office Action dated Jan. 17, 2018 in corresponding Chinese Patent Application No. 201610160890.1.

* cited by examiner

REFRIGERATOR

CROSS-REFERENCE TO RELATED APPLICATION

This application claims the priority benefit of Korean Patent Application No. 10-2015-0038975, filed on Mar. 20, 2015 in the Korean Intellectual Property Office, the disclosure of which is incorporated herein by reference.

BACKGROUND

1. Field

Embodiments of the present invention relate to a refrigerator, and more particularly, to a technology for improving a refrigerator door structure.

2. Description of the Related Art

Generally, a refrigerator includes a main body having an inner casing and an outer casing, a storage chamber formed by the inner space, and a cool air supply device to supply cool air to the storage chamber, to thereby store foods in a fresh state.

A temperature of the storage chamber is maintained within a predetermined range needed to store foods in the fresh state.

The storage chamber of the refrigerator has an opened front surface, and the opened front surface is closed by a door in such a manner that a temperature of the storage chamber can be properly maintained at ordinary times.

The storage chamber is divided into a refrigerating chamber located at the right side and a freezing chamber located at the left side. The refrigerating chamber is opened or closed by a refrigerating chamber door rotatably coupled to the main body, and the freezing chamber is opened or closed by a freezing chamber door rotatably coupled to the main body.

As the number of large capacity refrigerators is rapidly increasing, a storage space of each door of the refrigerator is also increasing. In addition, a double door is developed and each door of the refrigerator is increased in thickness, such that the distance between a main body of the refrigerator and a rotation shaft of the refrigerator door becomes longer Therefore, a large separation distance between the door and the front surface of the main body occurs during rotation of the refrigerator door, a user's finger is caught in the refrigerator door, the appearance of the refrigerator is ruined, and the storage chamber is largely exposed to the outside, resulting in reduction of energy efficiency.

A magnet member is located in a gasket disposed between the door and the main body, resulting in increased thickness of the gasket. As the gasket thickness is increased, cool air of the storage chamber unexpectedly leaks to the outside.

In addition, the cool air of the storage chamber also leaks to the outside by a front center plate provided in a partition.

SUMMARY

Therefore, it is an aspect of the present invention to provide a refrigerator for preventing a user's finger from being caught in a space between a refrigerator door and a main body, resulting in improved aesthetics of the refrigerator.

It is another aspect of the present invention to provide a refrigerator for increasing heat efficiency by improving a gasket structure of refrigerator doors.

It is another aspect of the present invention to provide a refrigerator for increasing heat efficiency by improving a seating member structure of a hot pipe provided in a partition.

Additional aspects of the invention will be set forth in part in the description which follows and, in part, will be obvious from the description, or may be learned by practice of the invention.

In accordance with an aspect of the present invention, a refrigerator includes: a main body configured to have a storage chamber therein; a door rotatably disposed at a front of the main body so as to open or close the storage chamber, and configured to have a rotation shaft located at a front of the main body and spaced apart from the main body; and a protection member coupled to the main body such that the protection member is disposed between the rotation shaft of the door and the main body.

The door may rotate about the rotation shaft while maintaining a separation distance between one side of the door and the protection member during opening/closing operations of the door.

The door may further include: a front surface part forming a front surface of the door; a first side surface part extending in forward and backward directions of the main body so as to form a side surface located adjacent to the rotation shaft; and a rotation part protruding outward from the first side surface part.

The rotation part may include a curved surface having a curvature centered with respect to the rotation shaft of the door.

The rotation shaft of the door may be located outside the first side surface part in a horizontal direction of the first side surface part.

The protection member may include an adjacent part provided to correspond to an outer circumference of the rotation shaft while being spaced apart from the outer circumference of the rotation part by a separation distance; and wherein the separation distance between the outer circumference and the adjacent part may be maintained when the rotation part is rotated by rotation of the door during the opening/closing operations of the door.

The protection member may further include: an inner side part configured to face the first side surface part of the door when the door is closed.

The outer side part of the protection member may be arranged parallel to an outer portion of a side surface of the main body.

The protection member may be formed of material different from material of the main body, and is coupled to a front side of the main body.

The refrigerator may further include: a pair of magnet members located at a front side of the main body and a rear side of the door facing the front side of the man body, respectively, such that the pair of magnet members face each other when the door is closed.

The door may further include: a gasket arranged at the rear side of the door facing the front side of the main body, wherein no magnet is installed in the gasket.

The magnet member mounted to the door, of the pair of magnet members may be spaced apart from the gasket by a separation distance.

The main body may include: a hot pipe buried in a border of the storage chamber; and a seating member in which the hot pipe is seated, wherein the seating member is arranged in the main body such that the seating member is not exposed to the outside of the main body.

The main body may further include a partition wall configured to partition at least some parts of the storage chamber such that the storage chamber is divided into a refrigerating chamber and a freezing chamber. The seating member may be configured to support the hot pipe buried in the partition wall in a manner that the hot pipe is seated on the seating member, and is arranged in the partition wall without exposed to the outside of the partition.

In accordance with another aspect of the present invention, a refrigerator includes a main body configured to have a storage chamber therein; a door arranged at a front of the main body and configured to rotate about a rotation shaft located outside of the main body, wherein the door includes a front surface part forming a front surface of the door, a first side surface part extending in forward and backward directions of the main body so as to form a side surface adjacent to the rotation shaft, and a rotation part protruding outward from the first side surface part; and a protection member arranged to face the first side surface part when the door is closed, at least some parts of which are disposed between the rotation part and the main body.

The rotation part may include a curved surface having a curvature with respect to the rotation shaft of the door.

The protection member may include an adjacent part provided to correspond to an outer circumference of the rotation shaft while being spaced apart from the outer circumference of the rotation part. The separation distance between the outer circumference and the adjacent part may be maintained when the rotation part is rotated by rotation of the door during the opening/closing operations of the door.

The rotation shaft of the door may be located outside the first side surface part in a horizontal direction of the first side surface part.

The refrigerator may further include: a pair of magnet members located at a front side of the main body and a rear side of the door facing the front side of the main body, respectively, such that the pair of magnet members face each other when the door is closed.

The door may further include: a gasket provided at the rear side of the door facing the front side of the main body. The gasket and the magnet members may be positioned in the door without overlapping each other.

BRIEF DESCRIPTION OF THE DRAWINGS

These and/or other aspects of the invention will become apparent and more readily appreciated from the following description of the embodiments, taken in conjunction with the accompanying drawings of which.

DETAILED DESCRIPTION

Figure 1:
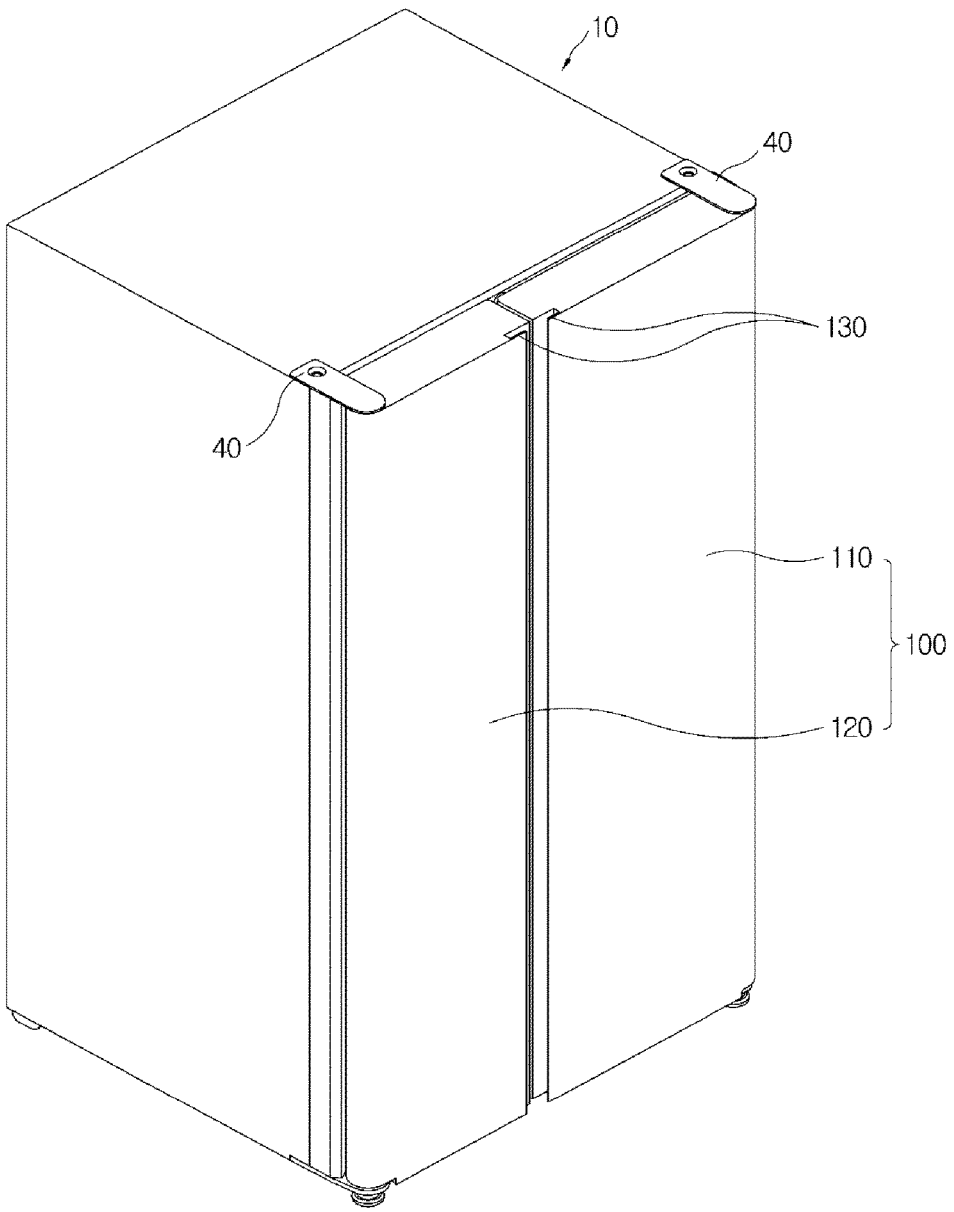
FIG. 1 is a perspective view illustrating a refrigerator according to an embodiment of the present invention.

Reference will now be made in detail to the embodiments of the present invention, examples of which are illustrated in the accompanying drawings, wherein like reference numerals refer to like elements throughout.

In the following description, the term "front surface" may refer to a front surface of the main body 10 of the refrigerator, the term "forward direction" may refer to a forward direction of the main body 10 of the refrigerator, and the term "backward direction" may refer to a backward direction of the main body 10 of the refrigerator.

Referring to FIGS. 1 to 4, the refrigerator may include a main body 10; a storage chamber 20 having an opened front surface in the main body 10, a door 100 rotatably located at a front of the main body 10 so as to open or close the storage chamber 20, and a hinge unit 40 through which the door 100 is rotatably coupled to the main body 10.

The main body 10 may include an inner casing 11 to form the storage chamber 20; an outer casing 13 to form the exterior appearance of the refrigerator; and a cool air supply device (not shown) to provide the cool air to the storage chamber 20.

The cool air supply device may include a compressor, a condenser, an expansion valve, an evaporator, a blowing fan, a cool air duct, etc. An insulator 15 is foamed between the inner casing 11 and the outer casing 13 of the main body 10 so as to prevent leakage of cool air from the storage chamber 20. The insulator 15 may be foamed in the door 100.

A machine room (not shown) is provided at a rear lower portion of the main body 10, in which a compressor to compress refrigerant and a condenser to condense the compressed refrigerant are mounted.

The storage chamber 20 is partitioned into a left storage chamber and a right storage chamber by a partition wall 50. The refrigerating chamber 23 is provided at the right side of the main body 10, and the freezing chamber 21 is provided at the left side of the main body 10.

Although the refrigerating chamber 23 is provided at the right side of the main body 10 and the freezing chamber 21 is provided at the left side of the main body 10 for convenience of description, the scope or spirit of the present invention is not limited thereto.

The refrigerating chamber 23 may include plural shelves 25 configured to divide the refrigerating chamber 23 into a plurality of spaces and on which foods are placed, and a storage container 27 to receive foods and store the foods therein.

The refrigerating chamber 23 is opened and closed by a refrigerating chamber door 110 rotatably coupled to the main body 10, and the freezing chamber 21 is opened and closed by a freezing chamber door 120 rotatably coupled to the main body 10. A hinge unit 40 is coupled to each of the upper and lower parts of the main body 10 such that the refrigerating chamber door 110 and the freezing chamber door 120 may be rotatably coupled to the main body 10.

The refrigerating chamber door 110 and the freezing chamber door 120 (hereinafter referred to as the doors 100) may be rotatably mounted to a front surface of the main body 10, and a plurality of plural door guards may be provided at a rear of the doors 100.

Each of the doors 100 may be provided with a handle 130 that a user grabs to open and close the doors 100.

A gasket 300, configured to seal the spacing between the main body 10 and the door 100 when the refrigerating chamber door 110 and the freezing chamber door 120 are closed, is mounted to the rear side of each of the refrigerating chamber door 110 and the freezing chamber door 120 so as to prevent leakage of cool air contained in the storage chamber 20. The gasket 300 will hereinafter be described in detail.

Figure 4:
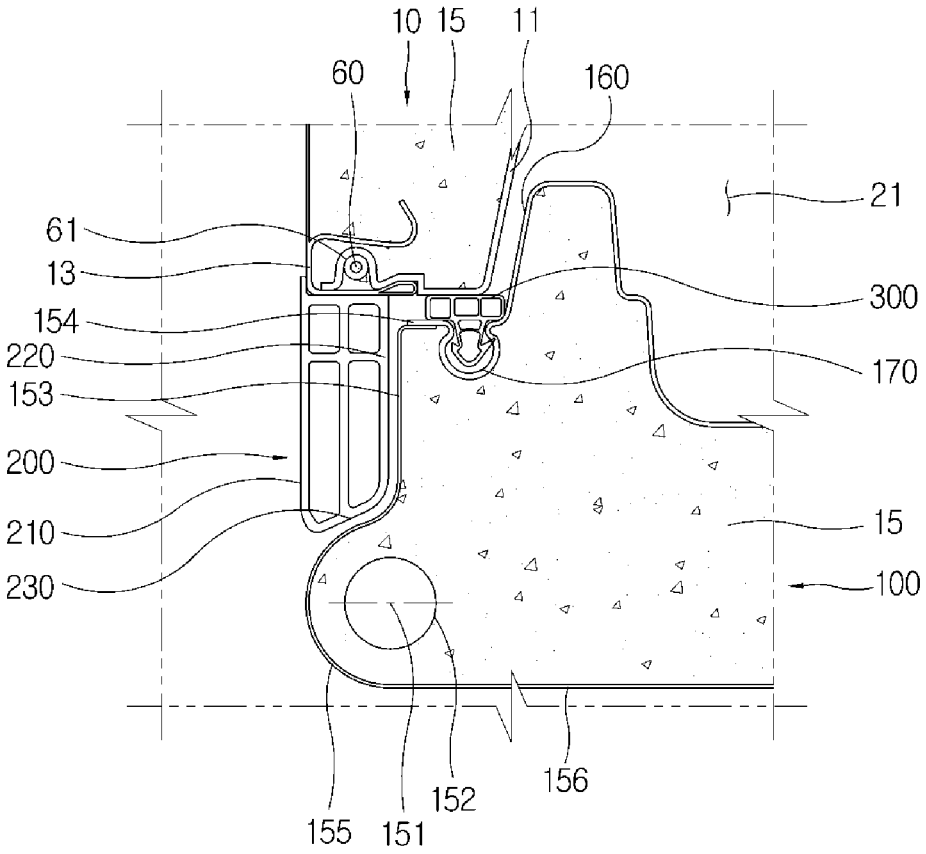
FIG. 4 is a cross-sectional view illustrating some parts provided at one side of the door of the refrigerator according to an embodiment of the present invention when the door is closed.
Figure 6:
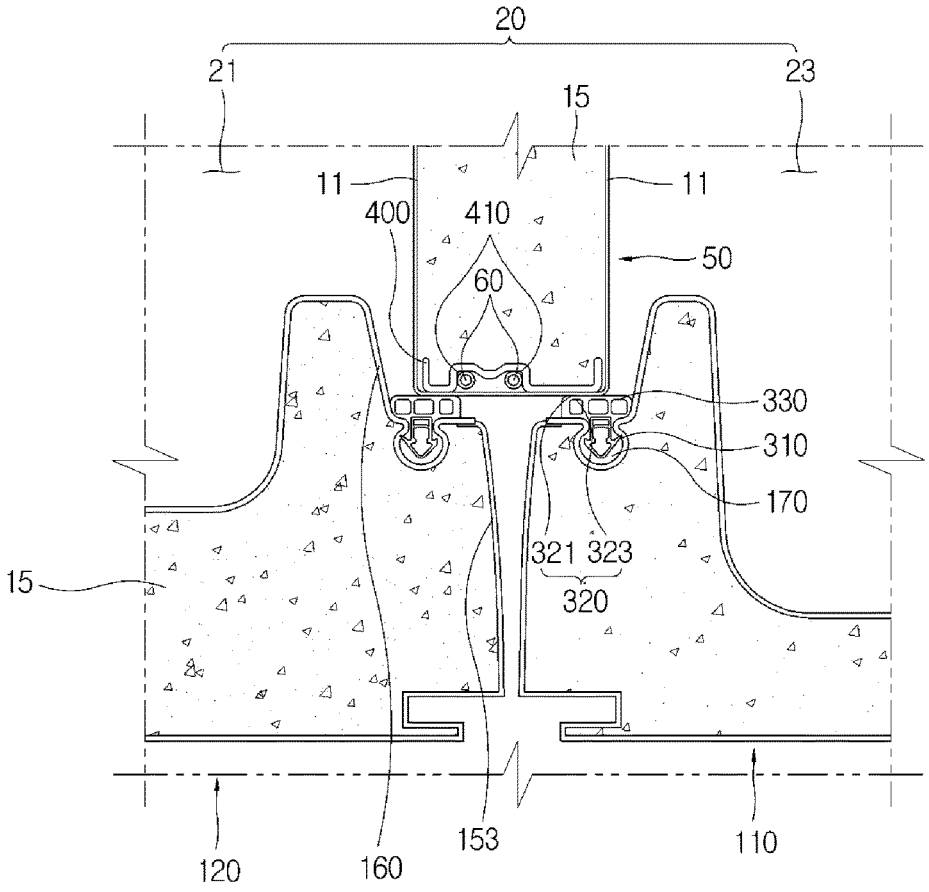
FIG. 6 is a cross-sectional view illustrating some parts located adjacent to a partition wall in the door of the refrigerator according to an embodiment of the present invention when the door is closed.

Referring to FIGS. 4 and 6, a hot pipe 60 to prevent dew from being formed at the outer casing 13 is provided in the border (brim) of the front surface of the inner casing 11 of the main body 10.

If the refrigerator operates, the cool air contained in the storage chamber 20 is introduced to the outer casing 13 forming the external appearance, such that dew may be formed at the external surface of the outer casing 13 due to a difference in temperature between the inner space and the outer space of the outer casing 13.

In order to prevent dew from being formed at the external surface of the outer casing 13, a hot pipe 60 in which high-temperature refrigerant flows may be fixed at a border (i.e., a border of the storage chamber 20) of the front surface of the inner casing 11.

The hot pipe 60 passing through the partition wall 50 of the front surface border of the inner casing 11 may be provided in the inner casing 11 by a seating part 61 arranged in the inner casing 11, may be buried in the insulator 15 and then fixed.

The seating part 61 may be located at a position that is closest to the outer casing 13 when the inner casing 11 is coupled to the outer casing 13.

Since the seating part 61 is located closest to the outer casing 13, the hot pipe 60 seated in the seating part 61 may be located farthest from the inside of the storage chamber 20 and may be located closest to the outer casing 13.

If high-temperature heat is applied to the inside of the storage chamber 20, the internal temperature of the storage chamber 20 is increased by the high-temperature heat, so that energy consumption needed to lower the internal temperature of the storage chamber 20 may be reduced.

In addition, since the hot pipe 60 is located closest to the outer casing 13, high-temperature heat caused by high-temperature refrigerant flowing in the hot pipe 60 may reduce difference in temperature between the external part and the internal part of the outer casing 13, thereby preventing dew from being formed at the outer circumference of the outer casing 13.

A seating member 400 may be additionally provided in the hot pipe 60 passing through the partition wall 50 so as to facilitate the assembly of the inner casing 11. A detailed description of the seating member 400 will hereinafter be given.

A detailed description of the door 100 will hereinafter be given. A first coupling structure in which the refrigerating chamber door 110 is rotatably coupled and a second coupling structure in which the freezing chamber door 120 is rotatably coupled are bilaterally symmetrical to each other. As such, as an example of the coupling structures, only the first coupling structure will hereinafter be described and a detailed description of the second coupling structure will herein be omitted for convenience of description. Hereinafter, reference numeral 100 is used to represent the refrigerating chamber door 110.

Figure 3:
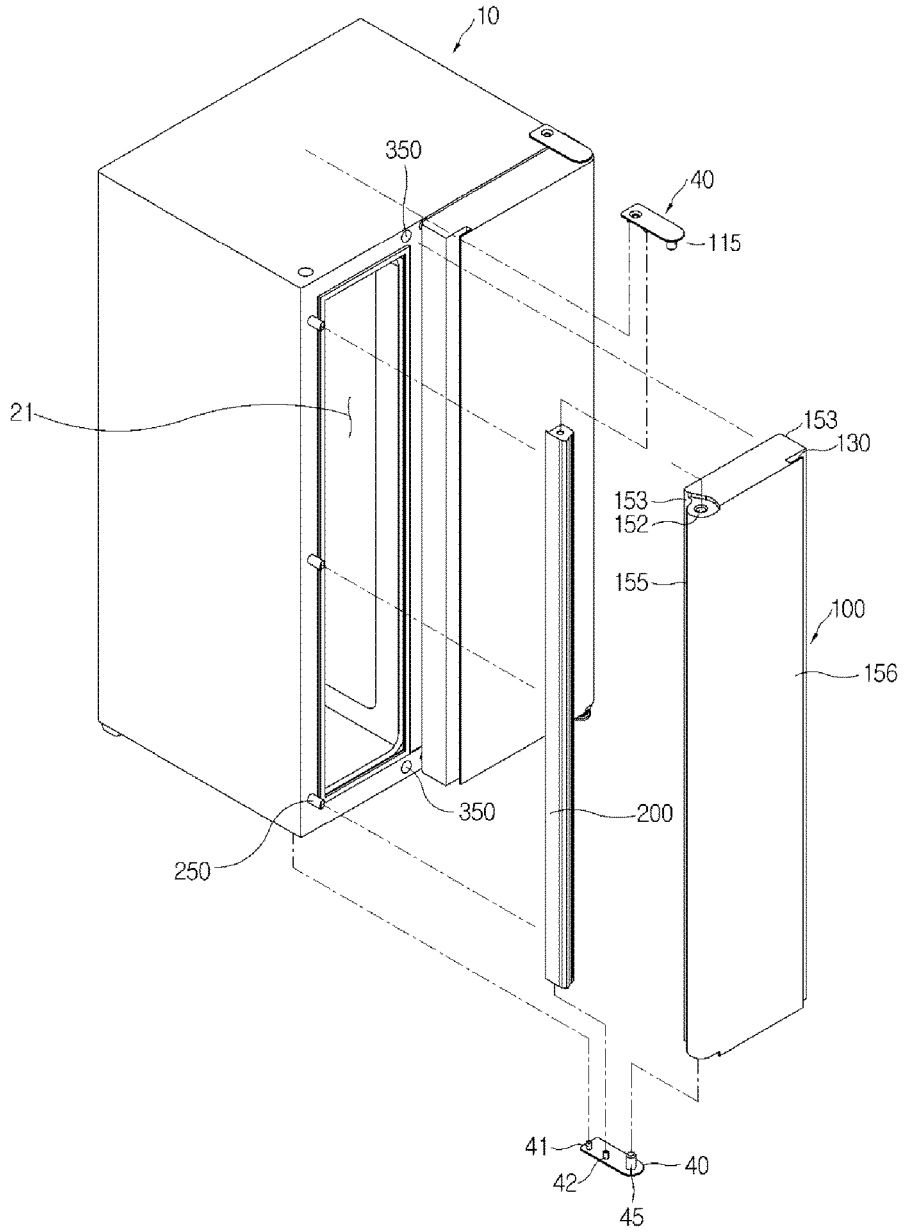
FIG. 3 is an exploded perspective view illustrating some parts of the refrigerator according to an embodiment of the present invention.

As shown in FIGS. 3 and 4, the doors 110 and 120 may be rotatably coupled to the refrigerating chamber door 110 and the freezing chamber door 120 by the hinge unit 40.

A door coupling part 41 may be provided at one side of the hinge unit 40 such that the hinge unit 40 is coupled to the upper part and the lower part of the main body 10. A door coupling groove corresponding to the door coupling part 41 is provided at each of the upper and lower parts of the main body 10, such that one side of the hinge unit 40 is supported.

The hinge unit 40 is provided at one side thereof with the door coupling part 41, and at the other side thereof with a rotation coupling part 45 coupled to the door 100, in which the other side of the hinge unit 40 is provided forward of the one side of the hinge unit 40.

The rotation coupling part 45 is formed in a cylindrical shape and inserted into the inside of the door 100. In another example, the rotation coupling part 45 may be formed in a shaft shape so that the rotation coupling part 45 may be arranged in a longitudinal direction of the door 100.

The center of a curvature of the cylinder shape of the rotation coupling part 45 may correspond to the rotation shaft 151 of the door 100. The door 100 is rotated on the rotation shaft 151 by user pressurization such that the storage chamber 20 may be opened. In contrast, when a user applies a force in the opposite direction, the door 20 may be rotated in a direction in which the storage chamber 20 is closed.

The door 100 may include a pair of rotation coupling grooves 152 formed at a upper end and a lower end of the door 100 to correspond to the rotation coupling parts 45. The rotation coupling groove 152 may have a diameter corresponding to the diameter of the rotation coupling part 45.

The door 100 may include a front surface part 156 forming the external appearance, a side surface part 153 forming a side surface of the door 100, a rear surface part 154 bent from the side surface part 153 toward the storage chamber 20 to face the main body 10 and the storage chamber 20, and a rotation part 155 in which the rotation shaft 151 of the door is located and which protrudes outward from the side surface part 153.

The front surface part 156 may be formed in a plate shape, and may substantially form the external appearance of the main body 10. The front surface part 156 may include stainless steel to improve aesthetics, or a film giving an appearance of stainless steel may be attached to the front surface part 156. Alternatively, various designs including a constant pattern or shape may be added to the front surface part 156.

One pair of the side surface parts 153 may extend in forward and backward directions of the main body 10. The side surface part 153 may be formed of the same material as the front surface part 156, and may be separately provided and assembled with the front surface part.

A side surface part 153 (hereinafter referred to as a first side surface part) located adjacent to the rotation shaft 151 will hereinafter be described.

A rotation part 155 may be formed by protruding from the first side surface part 153 outward of the first side surface part 153.

The rotation part 155 may have a curved surface having a curvature of centered with respect to the rotation shaft 151. In more detail, the rotation part 155 may be provided in a shape in which a cylindrical shape, having a curvature with respect to the rotation shaft 151 of the door 100, partially protrudes outward from the first side surface part 153.

In order to maintain a constant distance between the rotation part 155 and the main body 10 when the door 100 is rotated by the opening/closing operation of the door 100, the outer circumference of the rotation part 155 and the rotation part 155 may be spaced apart from by a constant distance along the rotation shaft 151.

As a result, when the door 100 is rotated by the opening/closing operation of the door 100, a separation distance between the rotation part 155 and one side of the main body 10 may be maintained to be constant.

The rear surface part 154 extends from the first side surface part 153 and is bent to be perpendicular to the first side surface part 153. When the door 100 is closed, the rear surface part 154 may face the main body 10 and the storage chamber 20.

A gasket 300 contacting a part serving as the border of the storage chamber 20 of the main body 10 may be arranged in the rear surface part 154, such that the gasket 300 may maintain the temperature of the storage chamber 20 and protect the cool air formed in the storage chamber 20 from the external part on the condition that the door 100 is closed. A detailed description of the gasket 300 is as follows.

The rear surface part 154 of the door 100 may further include a door liner 160 extending inward from the storage chamber 20.

The door liner 160 may be designed to correspond to the shape of the inner casing 11 forming the storage chamber 20. Therefore, the door liner 160 may extend from the rear surface part 154 to correspond to a portion of the inner casing 11 bent inward the storage chamber 20 at the border of the main body 10.

A space in which the above-mentioned door guard 30 is located may be formed at an inner side of the door liner 160.

Figure 5A:
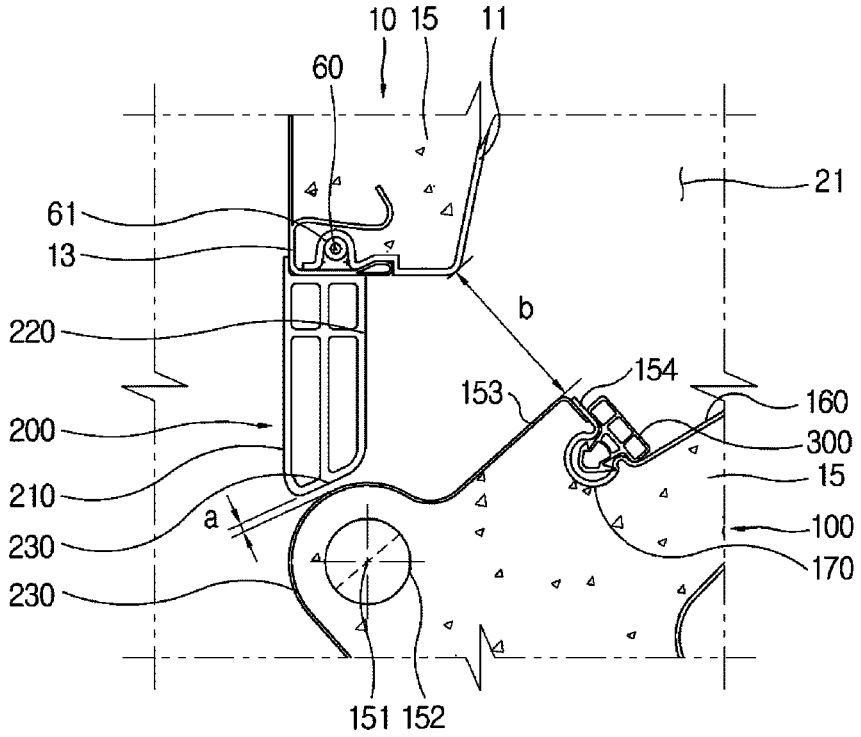
FIG. 5A is a cross-sectional view illustrating some parts provided at one side of the door of the refrigerator according to an embodiment of the present invention when the door is partially opened.
Figure 5B:
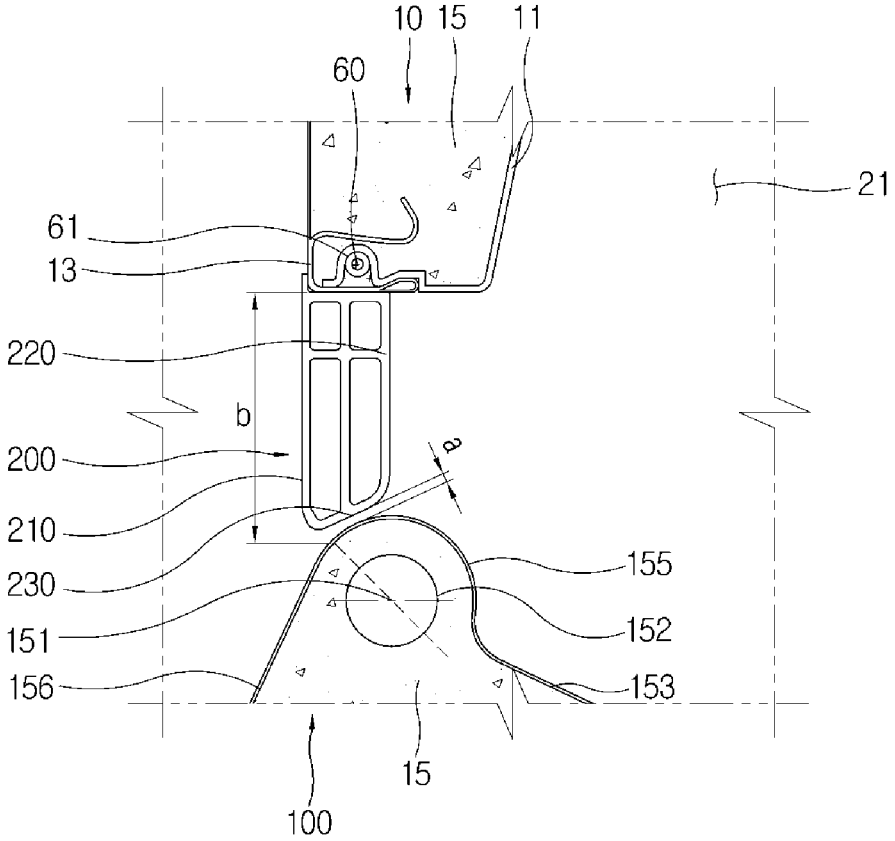
FIG. 5C is a cross-sectional view illustrating some parts provided at one side of the door of the refrigerator according to an embodiment of the present invention when the door is opened.
Figure 5C:
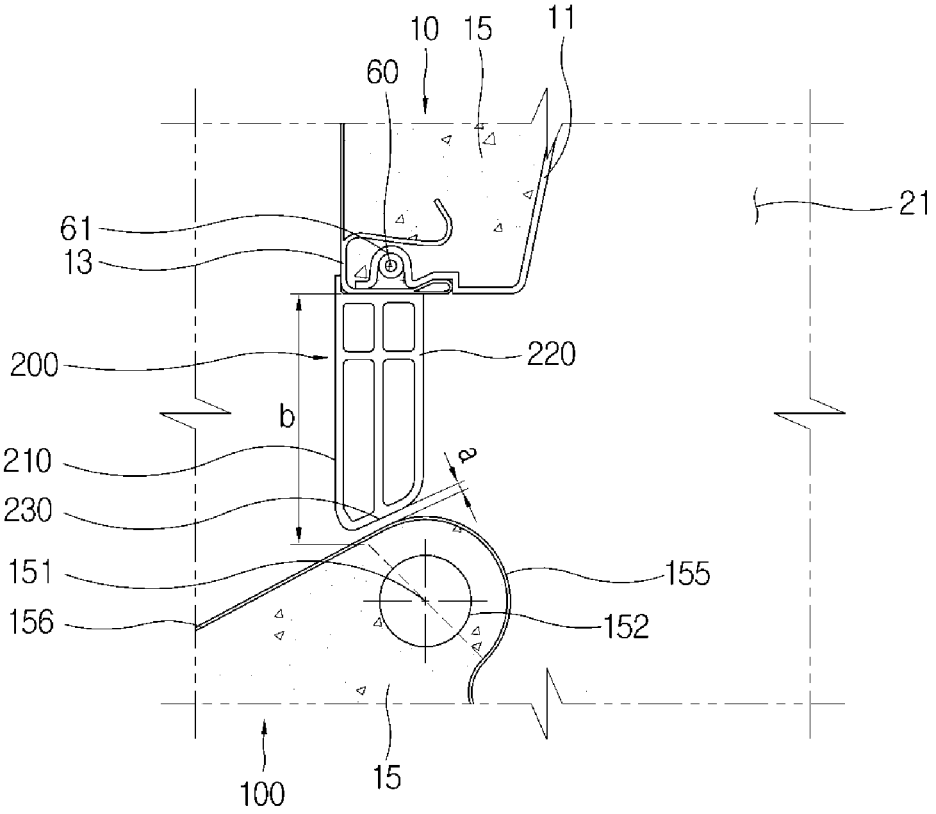

Referring to FIGS. 5A to 5C, when the door 100 is rotated by the opening/closing operation of the door 100, the first side surface part 153 of the door 100 may rotate about the rotation shaft 151.

In this case, a protection member 200 may be designed to cover a separation distance generated between the main body 10 and the door 100 when the first side surface part 153 rotates together with the door 100.

When the door 100 is closed, the protection member 200 faces the first side surface part 153 when the door 100 is closed, and at least some parts of the protection member 200 is located between the rotation part 155 and the main body 10.

The protection member 200 may include an outer side part 210 facing the outer side of the main body 10, an inner side part 220 facing the first side surface part 153 when the door 100 is closed, and an adjacent part 230 extending from the inner side part 220 and the outer side part 210 and corresponding to the outer circumference of the rotation part 155 while having a separation distance (a) from the outer circumference of the rotation part 155.

The outer side part 210 may be located parallel to the outermost line of a lateral side surface of the main body 10, resulting in improved aesthetics of the main body 10. The outer side part 210 may be formed of the same material forming the lateral side surface of the main body 100 or the door 100.

The inner side part 220 may face the first side surface part 153 when the door 100 is closed, and may be provided adjacent to the storage chamber 20 when the door 100 is opened. The inner side part 220 may prevent a user's finger from being caught in a gap between the main body 10 and the door 100 when the door 100 is opened, and prevent cool air of the storage chamber 20 from leaking to the outside.

The adjacent part 230 may extend from the inner side part 220 and the outer side part 210, and may include a curved surface. The curved surface of the adjacent part 230 may be provided to correspond to the outer circumferential surface of the rotation part 155.

The separation distance (a) between the adjacent part 230 and the rotation part 155 is provided. During rotation of the door 100, the rotation part 155 may rotate about the rotation shaft 151, while maintaining a predetermined separation distance (a) from the adjacent part 230.

Referring to FIGS. 5A to 5C, the first side surface part 153 configured to maintain a sealed state between the main body 10 and the door 100 may be gradually distant away from the main body 10 as the door 100 is gradually opened as the door 100 rotates about the rotation shaft 151 during rotation of the door 100.

In more detail, a minimum distance (b) between the main body 10 and the door 100 may be changed according to the opening degree of the door 100. When the shortest distance (b) between the main body 10 and the door 100 is increased by a predetermined distance, the user's finger may be put into a space between the main body 10 and the door 100 and injured.

However, according to the embodiment of the present disclosure, the protection member 200 is separately provided, the separation distance (a) between the protection member 200 and the rotation part 155 is maintained to be constant regardless of the rotation of the door 100, thereby preventing a user's finger from being injured, and also covering a separation distance generated when the door 100 is opened, resulting in improved aesthetics of the refrigerator.

The protection member 200 is coupled to the main body 10 as the coupling protrusion 250 provided at the main body 10 is coupled to a coupling protrusion groove provided at the protection member 200. In addition, the upper and lower ends of the protection member 200 may be supported by second coupling parts 42 provided at the hinge members 40.

Differently from the embodiment in which the protection member 200 is designed as a separate member, the outer casing 13 may be molded to have a protrusion, such as the protection member 200.

In other words, both side ends of the front surface part of the main body 10 may protrude forward in the same manner as the protection member 200. In this case, the insulator 15 or the like may be filled inside the outer casing 13.

The gasket 300 and the magnet member 350 will hereinafter be described in detail.

Figure 2:
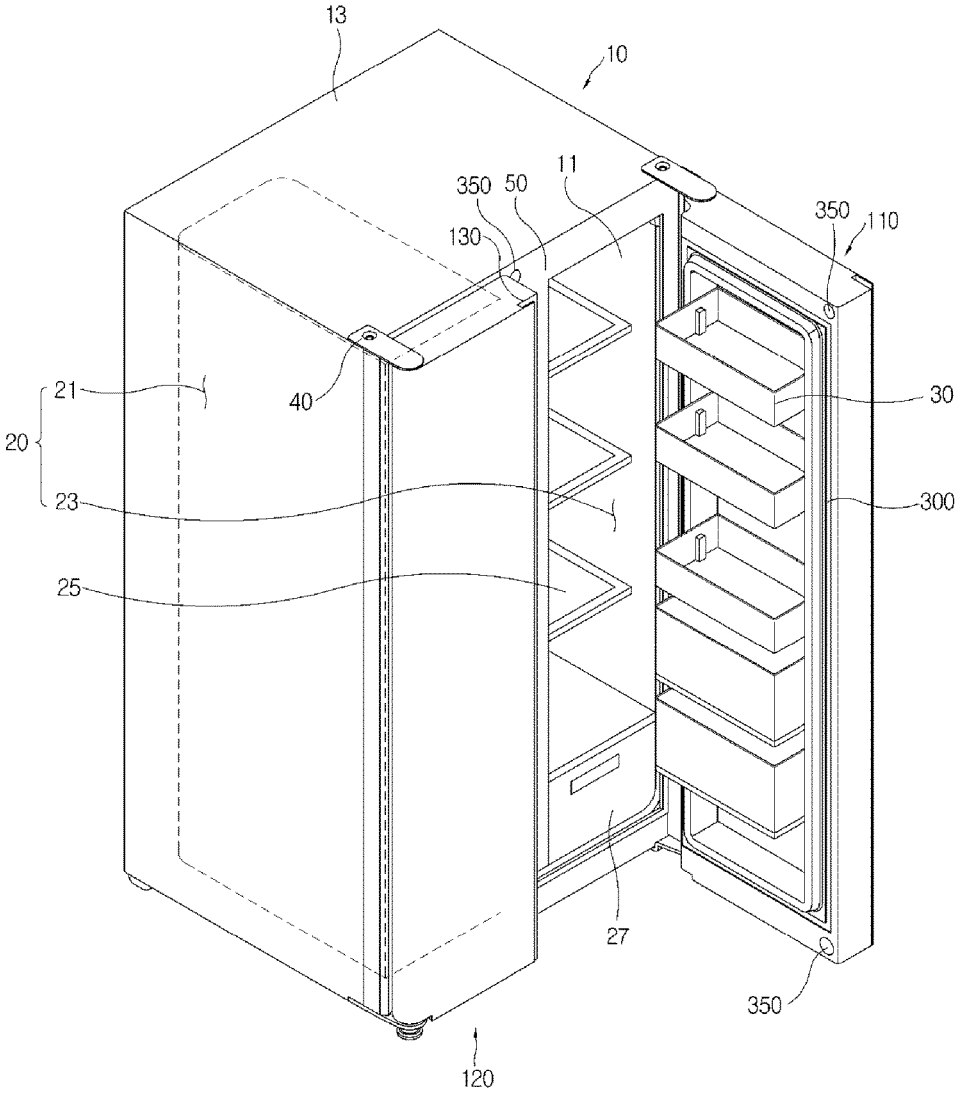
FIG. 2 is a perspective view illustrating the refrigerator according to an embodiment of the present invention when a door of the refrigerator is open.

Referring to FIGS. 2 and 6, the gasket may be inserted in the rear side of the door 100 in such a manner that the gasket 300 is located to face the main body in the closed state of the door 100.

The gasket 300 may be formed in a square frame shape corresponding to the border of the storage chamber 20, and may be inserted into the rear surface part 154 of the door 100. When the door 100 is closed, the gasket 300 may maintain the sealed state between the main body 10 and the door 100, such that the gasket 300 may prevent the cool air of the storage chamber from leaking outside.

The gasket 300 may include a gasket coupling part 310 coupled to the rear surface part 154 of the door 100, a close contact part 320 coming into close contact with the main body 10 when the door 100 is closed such that a sealed state between the main body 10 and the door 100 may be maintained, and a cool air leakage prevention part 330 extending from one side of the close contact part 320 toward the storage chamber 20 so as to prevent the cool air from leaking through an opening (or gap) between the main body 10 and the door 100.

The gasket coupling groove 170 coupled to the gasket 300 may be provided at the rear side of the door 100, and the gasket coupling part 310 may be coupled to the gasket coupling groove 170.

The close contact part 320 may include a contact part 321 configured to contact the main body 10 when the door 100 is closed, and a shock absorption part 323 configured to absorb shock generated between the main body 10 and the door 100 when the door 100 is closed.

The cool air leakage prevention part 330 may prevent the cool air of the storage chamber 20 from leaking through the opening (or gap) between the main body 10 and the door 100.

In accordance with the embodiment, the magnet is not inserted in the gasket 300. Therefore, the gasket 300 does not include a magnet assembly part that is generally provided in the gasket 300.

In general, the magnet assembly part may be disposed between the shock absorption part 323 and the contact part 321. As the thickness of the gasket 300 is increased as much as a thickness of the magnet assembly part and an additional rib structure supporting the magnet assembly part is provided in the gasket 300, not only does the thickness of the gasket 300 increase, but also the width of the gasket 300 increases.

As the gasket 300 is increased in size, specifically, as the gasket 300 is increased in thickness, the area of the gasket 300 exposed to the outside is increased, so that there is a higher possibility that the cool air of the storage chamber 20 leaks to the outside.

The gasket 300 has a lower insulation characteristic than the main body 10 or the door 100, and as the gasket is exposed to the outside, a region in which heat exchange occurs between the cold air in the storage chamber 20 and the outside air is increased.

Therefore, the gasket 300 according to the embodiment has a small thickness such that the separation distance between the main body 10 and the door 100 is minimized when the door 100 is closed, and leakage of the cool air of the storage chamber 20 may be effectively prevented.

Each of the door 100 and the main body 10 may include magnet members 350 located not only at a position not overlapping the gasket 300 but also at the other position not overlapping a specific position facing the gasket 300.

That is, the magnet members 350 may be located at the door 100 above the gasket 300 provided on an upper portion of the door 100, and may be located at the door below the gasket 300 provided on a lower portion of the door 100.

Differently from the embodiment, plural magnet members 350 may be provided at each of the upper portions and the lower portions of the refrigerating chamber 23 and the freezing chamber 21. Each magnet member 350 may also be formed in other shapes instead of the circular shape.

A detailed structure of the hot pipe 600 installed in the partition wall 500 will be given.

Referring to FIGS. 4 and 6, the hot pipe 60 may be seated in the border part of the storage chamber 20 by the seating part 61 mounted to the inner casing 11, and when the insulator 15 is filled in the inner casing 11 after completing assembly of the inner casing 11 and the outer casing 13, the hot pipe 60 is buried in the inner casing and fixed therein.

In the case of the refrigerator in which the storage chamber 20 is horizontally partitioned into the freezing chamber 21 and the refrigerating chamber 23, the hot pipe 60 may be arranged in each of the borders of the refrigerating chamber 23 and the freezing chamber 21. In this case, the hot pipe 60 may pass through the partition wall 50 corresponding to one side of the borders of the refrigerating chamber 23 and the freezing chamber 21.

According to the conventional refrigerator, plural inner casings 11 forming the refrigerating chamber 23 and the freezing chamber 21 are coupled by a front center plate at a side of the partition wall 50.

At an inside of the partition wall 50, the hot pipe 60 is seated on the seating member 61 arranged in each inner casing 11, and at a front surface of the partition wall 50, the front center plate formed of steel is provided.

The front center plate has a size corresponding to a front surface part of the partition wall 50, and at least one portion of the front center plate may be exposed to the inside of the storage chamber 20 when the door 100 is closed.

However, since the front center plate is formed of steel having high thermal conductivity, cool air of the storage chamber 20 leaks to the outside through the front center plate, resulting in degradation of energy efficiency of the refrigerator.

The partition wall 50 according to the embodiment may not be formed using plural inner casings 11 extending from the refrigerating chamber 21 and the freezing chamber 23, but formed using a single inner casing 11 in an integral structure. having a bent shape.

Since the partition wall 50 is formed using the inner casing 11 having an integral structure, the front center plate supporting the hot pipe 60 when plural inner casings 11 are assembled may serve as the seating member 400 supporting the hot pipe 60 according to the embodiment of the present invention.

The seating member 400 may not support or fix the inner casing 11 when the inner casing 11 is assembled, differently from the front center plate. The seating member 400 may be located in the inner casing 11 and support the hot pipe 60 in the inner casing 11.

Although the seating member 400 may be formed of steel, the seating member 400 is not exposed to the outside, so that cool air of the storage chamber 20 does not leak to the outside.

A plurality of bent parts 410 may be provided on the seating member 400. Each bent part 410 may be designed to correspond to the curved surface of the hot pipe 60 such that the hot pipe 60 is inserted into the bent part 410. The hot pipe 60 is supported by the bent parts 410 and disposed in the inner casing 11.

Figure 7:
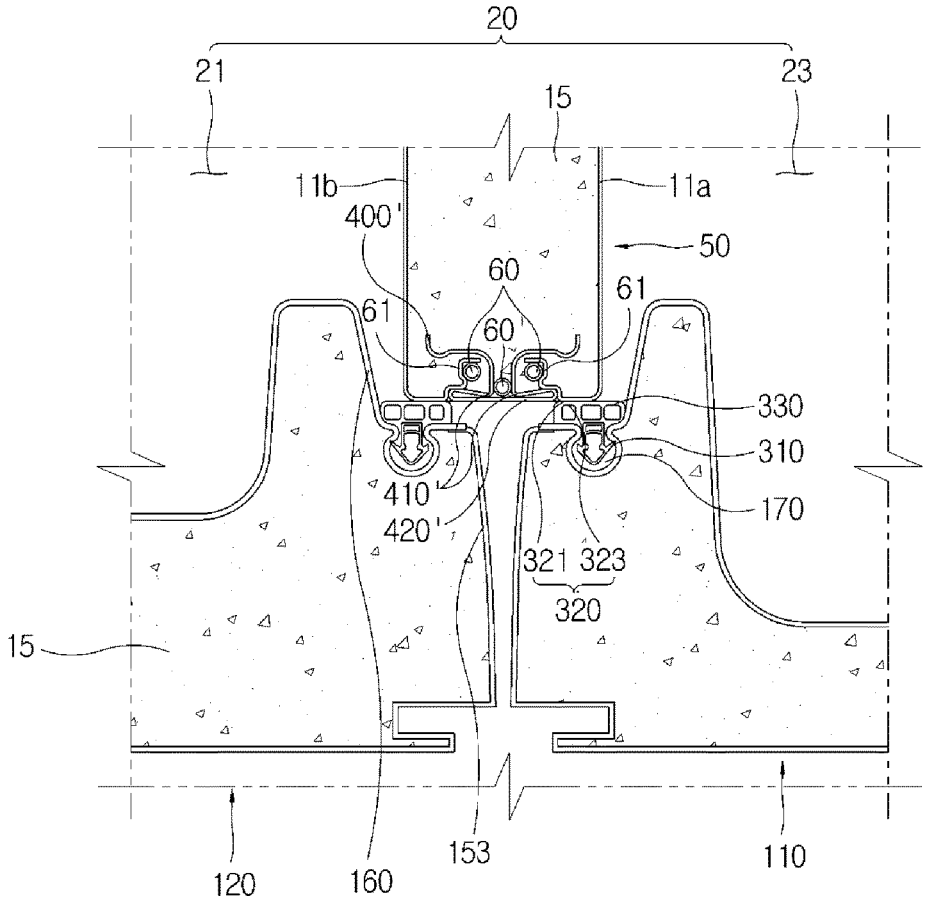
FIG. 7 is a cross-sectional view illustrating some parts located adjacent to a partition wall in the door of the refrigerator according to another embodiment of the present invention when the door is closed.
Figure 8:
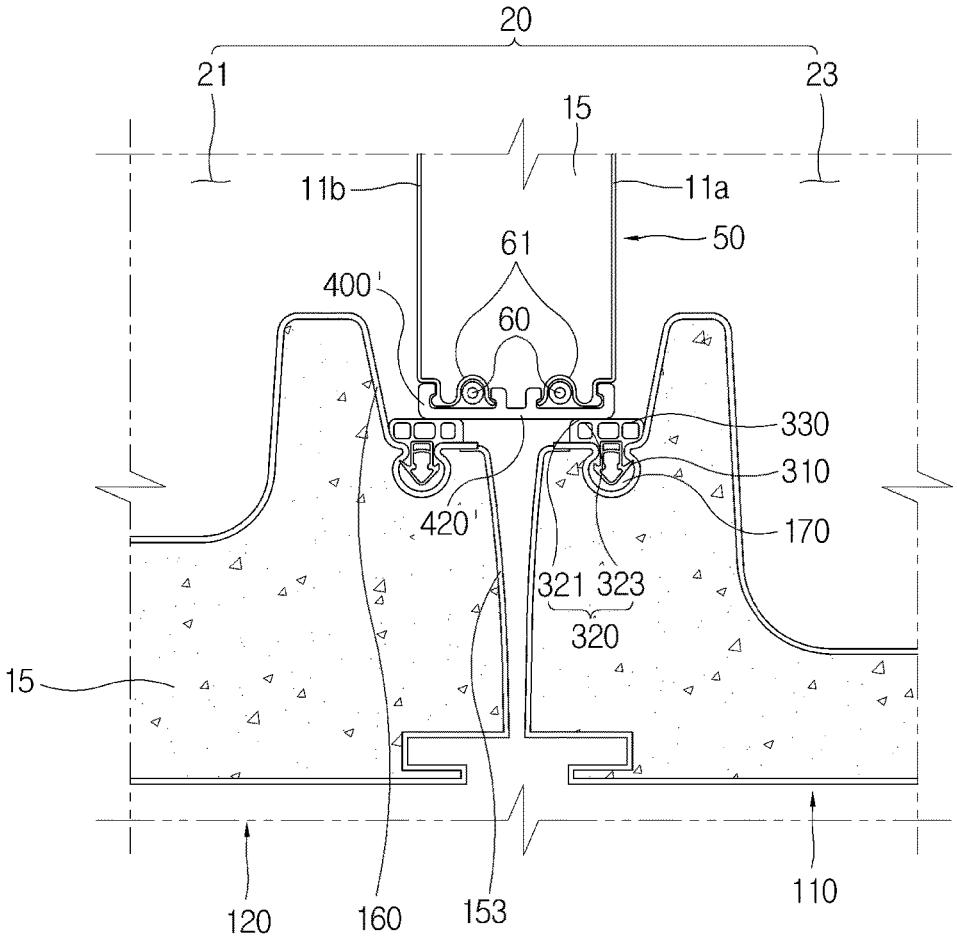
FIG. 8 is a cross-sectional view illustrating some parts located adjacent to a partition wall in the door of the refrigerator according to another embodiment of the present invention when the door is closed.

FIGS. 7 and 8 illustrate other embodiments of the present invention.

As can be seen from FIG. 7, the seating member 400 may be designed in a shape similar to that of the conventional front center plate. End parts of a plurality of inner casings 11*a* and 11*b* extending from the refrigerating chamber 23 and the freezing chamber 21 are disposed at a side of the partition wall 50, and the plurality of hot pipes 60 may be seated in a seating part 61' mounted to the end parts of the inner casing 11.

The plurality of inner casings 11*a* and 11*b* in which the hot pipe 60 is seated may be finally assembled by a seating member 400' directed from the front surface of the main body 10 to the inner casings 11*a* and 11*b*.

The seating member 400' may include a plate-shaped exposure part 420' exposed to the front surface part of the partition wall 50, and a bent part 410' which extends from the exposure part 420' toward the inside of the inner casings 11*a* and 11*b*, fixes the hot pipe 60 seated in the seating part 61, and additionally fixes a separate hot pipe 60'.

Differently from the conventional front center plate, the seating member 400' may be designed in a manner that the exposure part 420' correspond only to a portion of the front surface of the partition wall 50. That is, a horizontal length of the exposure part 420' may be shorter than that of the partition wall 50.

As a result, the seating member 400' formed of steel is not inserted into the storage chamber 20 when the door 100 is opened or closed, thereby preventing the cool air of the storage chamber 20 from leaking to the outside through the seating member 400'.

In more detail, the exposure part 420' may extend to the range in which both ends of the exposure part 420' do not overlap the close contact part 320 of the gasket 300 contacting with both sides of the partition wall 50 when the door 100 is closed.

When the close contact part 320 of the gasket 300 is disposed to overlap the exposure part 420', the cool air of the storage chamber 20 may be transferred to the exposure part 420' through the gasket 300. The cool air of the storage chamber 20 transferred to the seating member 400' through the gasket 300 may have heat exchange with outside air, and thus the heat efficiency may be lowered.

According, when the separation distance between the exposure part 420' and the gasket 300 facing the partition wall 50 is great, the heat efficiency of the refrigerating chamber may be increased.

As shown in FIG. 8, the seating member 400' according to another embodiment may have a predetermined size corresponding to the size of the front side of the partition wall 50.

The seating member 400' may be formed of plastic resin having low thermal conductivity, differently from the seating members 400,400' of the above-mentioned embodiments of the present invention.

Since the seating member 400' is formed of material having low thermal conductivity, heat efficiency of the refrigerator may not be greatly affected even when the seating member 400' extends to a part facing the gasket 300 of the partition wall 50.

However, the seating member 400', which formed of plastic resin or the like, has a thermoplastic property, and thus may exhibit poor durability when directly supporting the hot pipe 60. Accordingly, the seating member 400' may not directly support the hot pipe 60, differently from the above-mentioned seating members 400, 400', and may support one side of the inner casing supporting the hot pipe 60.

As is apparent from the above description, the refrigerator according to the embodiments can prevent the user's finger from being caught in the main body and improve the aesthetics of the refrigerator by using the protection member mounted to the main body of the refrigerator and the rotation part provided at one side of the door.

The refrigerator according to the embodiments can minimize a gasket thickness by using a gasket having no magnet assembly part located inside the gasket, resulting in increased heat efficiency of the refrigerator.

The refrigerator according to the embodiments can minimize the area of an exposed part of the seating member of the hot pipe provided in a partition, resulting in increased heat efficiency of the refrigerator.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A refrigerator comprising:

a main body configured to have a storage chamber therein;

a door rotatably disposed at a front of the main body so as to open or close to thereby open or close, respectively, the storage chamber, and the door configured to have a rotation shaft located at a front of the main body and spaced apart from the main body, wherein the door includes a side surface part extending in parallel with a body side surface of the main body when the door is closed such that the first side surface part forms a side surface adjacent to the rotation shaft, and a rotation part protruding from the side surface part, the rotation part encompassing the rotation shaft so that a center of the rotation shaft is along a longitudinal direction of the side surface; and a protection member coupled to the main body such that the protection member is disposed between the rotation shaft of the door and the main body, wherein the protection member includes an inner side part extending in parallel with the body side surface of the main body, and the inner side part is configured to face the side surface part of the door when the door is closed, and wherein, as the door rotates about the rotation shaft to open or close, a constant separation distance is maintained between the rotation part of the door and the protection member throughout the rotation of the door.

2. The refrigerator according to claim 1, wherein the door further includes:

a front surface part forming a front surface of the door.

3. The refrigerator according to claim 2, wherein the rotation part includes a curved surface having a curvature centered with respect to the rotation shaft of the door.

4. The refrigerator according to claim 2, wherein a portion of the rotation shaft of the door is located outside the side surface part in a horizontal direction of the side surface part.

5. The refrigerator according to claim 2, wherein:

the protection member further includes an outer side part that is arranged parallel to the body side surface of the main body, and an adjacent part extending from the inner side part to the outer side part and provided to correspond to an outer circumference of the rotation part while being spaced apart from the outer circumference of the rotation part by the constant separation distance; and wherein as the door rotates about the rotation shaft to open or close, the rotation part rotates and the separation distance is maintained between the outer circumference and the adjacent part throughout the rotation of the door.

6. The refrigerator according to claim 1, wherein the protection member further includes an outer side part that is arranged parallel to the body side surface of the main body.

7. The refrigerator according to claim 1, wherein the protection member is formed of material different from material of the main body, and is coupled to a front side of the main body.

8. The refrigerator according to claim 1, wherein the door further includes: a gasket including a gasket coupling part coupled to a rear surface part of the door and a close contact part coming into contact with a front side of the main body, wherein no magnet is installed in the gasket.

9. The refrigerator according to claim 1, further comprising:

a pair of magnet members located at a front side of the main body and a rear side of the door facing the front side of the man body, respectively, such that the pair of magnet members face each other when the door is closed, and the pair of magnet members being located above a gasket provided on an upper portion of the door or being located below a gasket provided on a lower portion of the door.

10. The refrigerator according to claim 9, wherein the magnet member mounted to the door, of the pair of magnet members, is spaced apart from the gasket by a second separation distance.

11. The refrigerator according to claim 1, wherein the main body includes:

a hot pipe buried in a border of the storage chamber; and a seating member including a plurality of bent parts to correspond to a curved surface of the hot pipe so that the hot pipe is seated in the plurality of bent parts, and seating member is arranged so that the seating member is not exposed to the outside of the main body.

12. The refrigerator according to claim 11, wherein:

the main body further includes a partition wall configured to partition at least some parts of the storage chamber such that the storage chamber is divided into a refrigerating chamber and a freezing chamber; and the seating member is configured to support the hot pipe buried in the partition wall in a manner that the hot pipe is seated on the seating member, and is arranged in the partition wall without exposed to the outside of the partition wall.

13. A refrigerator comprising:

a main body configured to have a storage chamber therein;

a door arranged at a front of the main body and configured to rotate about a rotation shaft located outside of the main body, wherein the door includes a front surface part forming a front surface of the door, a side surface part extending in parallel with a body side surface of the main body when the door is closed such that the side surface part forms a side surface adjacent to the rotation shaft, and a rotation part protruding from the side surface part, the rotation part encompassing the rotation shaft so that a center of the rotation shaft is along a longitudinal direction of the side surface; and a protection member including an inner side part extending in parallel with the body side surface of the main body, and the inner side part is arranged to face the side surface part when the door is closed, at least some parts of the protection member are disposed between the rotation part and the main body, wherein as the door rotates about the rotation shaft to open or close, the rotation part rotates and a constant separation distance is maintained between the rotation part of the door and the protection member throughout the rotation of the door.

14. The refrigerator according to claim 13, wherein the rotation part includes a curved surface having a curvature centered with respect to the rotation shaft of the door.

15. The refrigerator according to claim 14, wherein:

the protection member further includes an outer side part that is arranged parallel to the body side surface of the main body, and an adjacent part extending from the inner side part to the outer side part and provided to correspond to an outer circumference of the rotation part while being spaced apart from the outer circumference of the rotation part by the constant separation distance; and as the door rotates about the rotation shaft to open or close, the rotation part rotates and the constant separation distance is maintained between the outer circumference and the adjacent part throughout the rotation of the door.

16. The refrigerator according to claim 13, wherein a portion of the rotation shaft of the door is located outside the side surface part in a horizontal direction of the side surface part.

17. The refrigerator according to claim 13, further comprising:

a pair of magnet members located at a front side of the main body and a rear side of the door facing the front side of the main body, respectively, such that the pair of magnet members face each other when the door is closed, and the pair of magnet members being located above a gasket provided on an upper portion of the door or being located below a gasket provided on a lower portion of the door.

18. The refrigerator according to claim 17, wherein the door further includes:

a gasket including a gasket coupling part coupled to a rear surface part of the door and a close contact part coming into contact with the front side of the main body, wherein the gasket and the magnet members are positioned in the door without overlapping each other.

* * * * *